US006516819B1

(12) United States Patent
Pearson

(10) Patent No.: US 6,516,819 B1
(45) Date of Patent: Feb. 11, 2003

(54) BLIND HOLE FLUSHING DEVICE

(76) Inventor: Daniel Dean Pearson, 1310 Crossgate Dr., Evansville, IN (US) 47711

( * ) Notice: Subject to any disclaimer, the term of this patent is extended or adjusted under 35 U.S.C. 154(b) by 139 days.

(21) Appl. No.: 09/802,102

(22) Filed: Mar. 8, 2001

Related U.S. Application Data

(60) Provisional application No. 60/188,984, filed on Mar. 11, 2000.

(51) Int. Cl.[7] ..... B08B 3/02

(52) U.S. Cl. ..... 134/166 R; 134/167 R; 134/182; 134/183; 15/302; 15/321; 239/288

(58) Field of Search ..... 134/166 R, 166 C, 134/167 R, 168 R, 182, 183; 15/302, 320, 321; 239/288, 288.3, 288.5

(56) References Cited

U.S. PATENT DOCUMENTS

| | | | | |
|---|---|---|---|---|
| 383,964 | A | * | 6/1888 | MacKintosh |
| 517,274 | A | * | 3/1894 | Gollings |
| 2,417,222 | A | * | 3/1947 | Stine |
| 2,807,816 | A | * | 10/1957 | O'Brien |
| 3,172,415 | A | * | 3/1965 | Maushund |
| 3,215,350 | A | * | 11/1965 | Hetrick |
| 3,318,535 | A | * | 5/1967 | New |
| 3,897,002 | A | * | 7/1975 | Witty |
| 3,897,003 | A | * | 7/1975 | Zehr |
| 4,302,040 | A | * | 11/1981 | Lazar |
| 4,492,001 | A | * | 1/1985 | Hedrenius |
| 4,736,473 | A | * | 4/1988 | Gellatly |
| 4,756,480 | A | * | 7/1988 | Fish |
| 4,865,257 | A | * | 9/1989 | Bailey |
| 4,961,244 | A | * | 10/1990 | Stanfield et al. |
| 5,135,015 | A | * | 8/1992 | Young |
| 5,170,779 | A | * | 12/1992 | Ginsberg |
| 5,170,943 | A | * | 12/1992 | Artzberger |
| 5,589,080 | A | * | 12/1996 | Cho et al. |
| 5,735,833 | A | * | 4/1998 | Olson |
| 5,783,044 | A | * | 7/1998 | Schneider et al. |
| 6,210,381 | B1 | * | 4/2001 | Morse |
| 6,290,863 | B1 | * | 9/2001 | Morgan et al. |

FOREIGN PATENT DOCUMENTS

| | | | |
|---|---|---|---|
| DE | 198 40 093 | * | 3/2000 |
| FR | 1517911 | * | 3/1968 |

OTHER PUBLICATIONS

European Patent Office 438,680 Dec. 1990.*

* cited by examiner

*Primary Examiner*—Frankie L. Stinson
(74) *Attorney, Agent, or Firm*—George H. Morgan; Mark A. Manley

(57) ABSTRACT

A shield useful, in conjunction with an air gun with a medium conduit, in flushing debris from a blind hole. It comprises a case, an exhaust clearance, a hanger, a bottom clearance, and at least one guide with a clearance, and a plug useful for plugging an unused guide clearance. The medium conduit is inserted through a guide clearance which directs a medium, such as compressed air or nitrogen or liquid, towards the blind hole. The medium and debris from the blind hole flow out the exhaust clearance.

5 Claims, 9 Drawing Sheets

BLIND HOLE FLUSHING DEVICE

CROSS REFERENCES TO RELATED APPLICATIONS

Provisional Application for Patent 60/188,984 of Mar. 11, 2000 with the same title, "Blind Hole Flushing Shield" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a device useful in directing a medium such as, but not restricted to, a gas such as air or nitrogen or a fluid such as, but not restricted to, water into and around a blind hole, for the purpose of flushing debris from the blind hole with a directionally controlled exhaust.

2. Background Information

Cleaning out drilled material from a drilled blind hole is a problem. Often this is done with compressed air, which poses a safety hazard in that flying debris can become lodged in a person's eye. While using compressed air for cleaning parts is frowned on, people use it anyway for convenience.

As will be seen from the subsequent description, the preferred embodiments of the present invention overcome this and other shortcomings of prior art.

SUMMARY OF THE INVENTION

The present invention is a device useful for, but not restricted to, flushing debris from blind holes comprising a shield, an exhaust clearance, a hanger, a bottom clearance, a bottom, a side guide, a side guide clearance, a side guide reinforcement, a top guide, a top guide clearance, and a plug.

DESCRIPTION OF THE PREFERRED EMBODIMENTS

Figure 1:
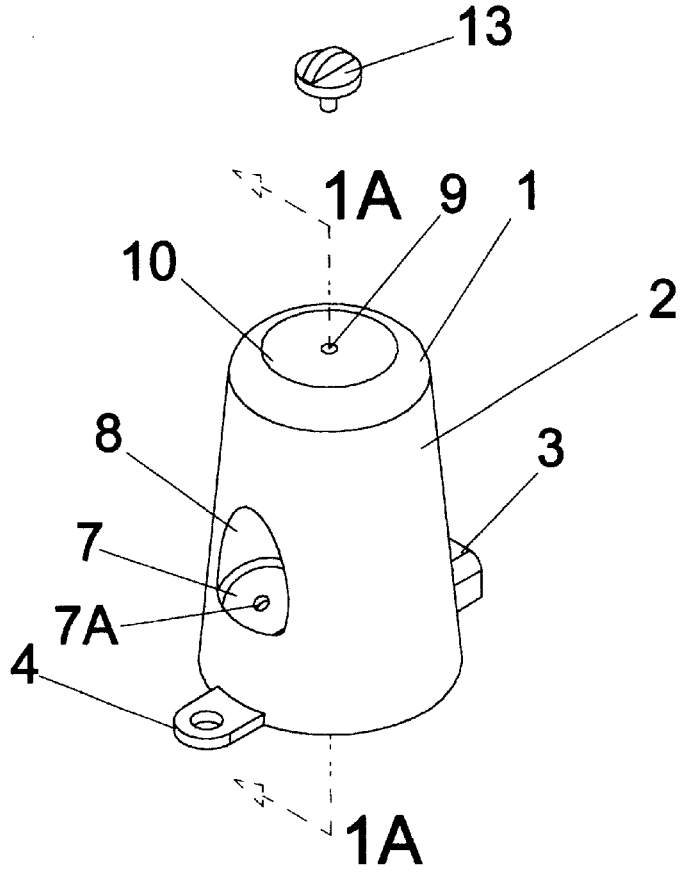
FIGS. 1 and 1A illustrate a preferred embodiment of the present invention, a blind hole flushing shield.

Referring to FIGS. 1, 1A, 2, and 3, a preferred embodiment of the present invention, a device useful in cleaning debris from a blind hole, said device being a blind hole flushing shield 1, comprises a case 2, a case cavity 2A, an outlet tunnel 3 with a tunnel exhaust clearance 5, a hanger 4, a bottom 6, a bottom clearance 6A, a side guide 7, a side guide clearance 7A, a side guide reinforcement 8, a top guide clearance 9, a top guide 10, and a plug 13.

A blind hole, in this case, refers to a hole that is closed at the bottom or that has a substantial restriction to the flow of a medium.

Figure 1A:
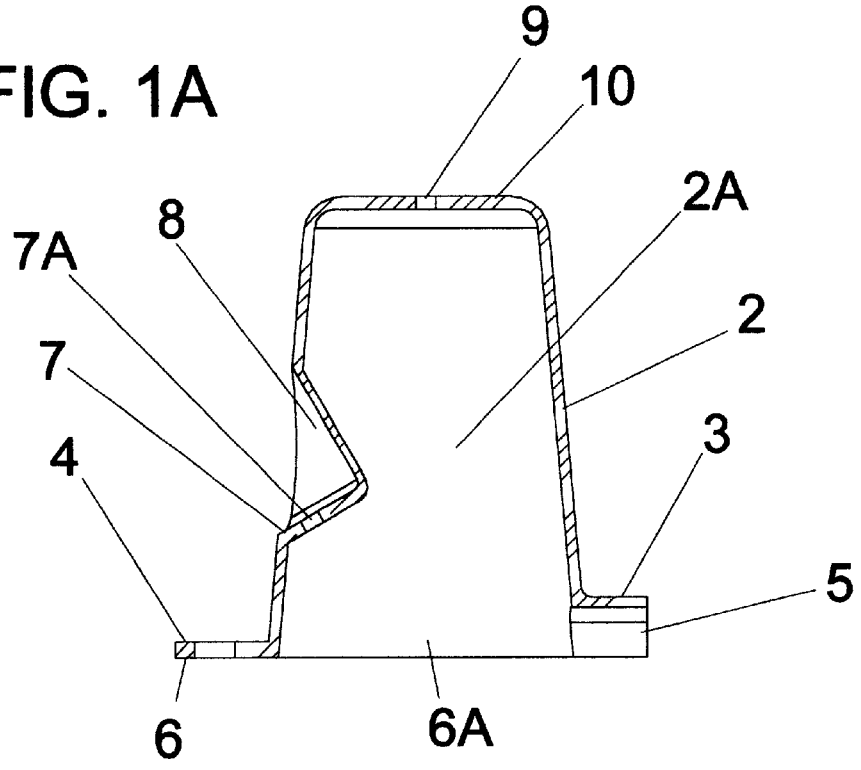

FIG. 1A is a cross section view of said shield 1.

Figure 2:
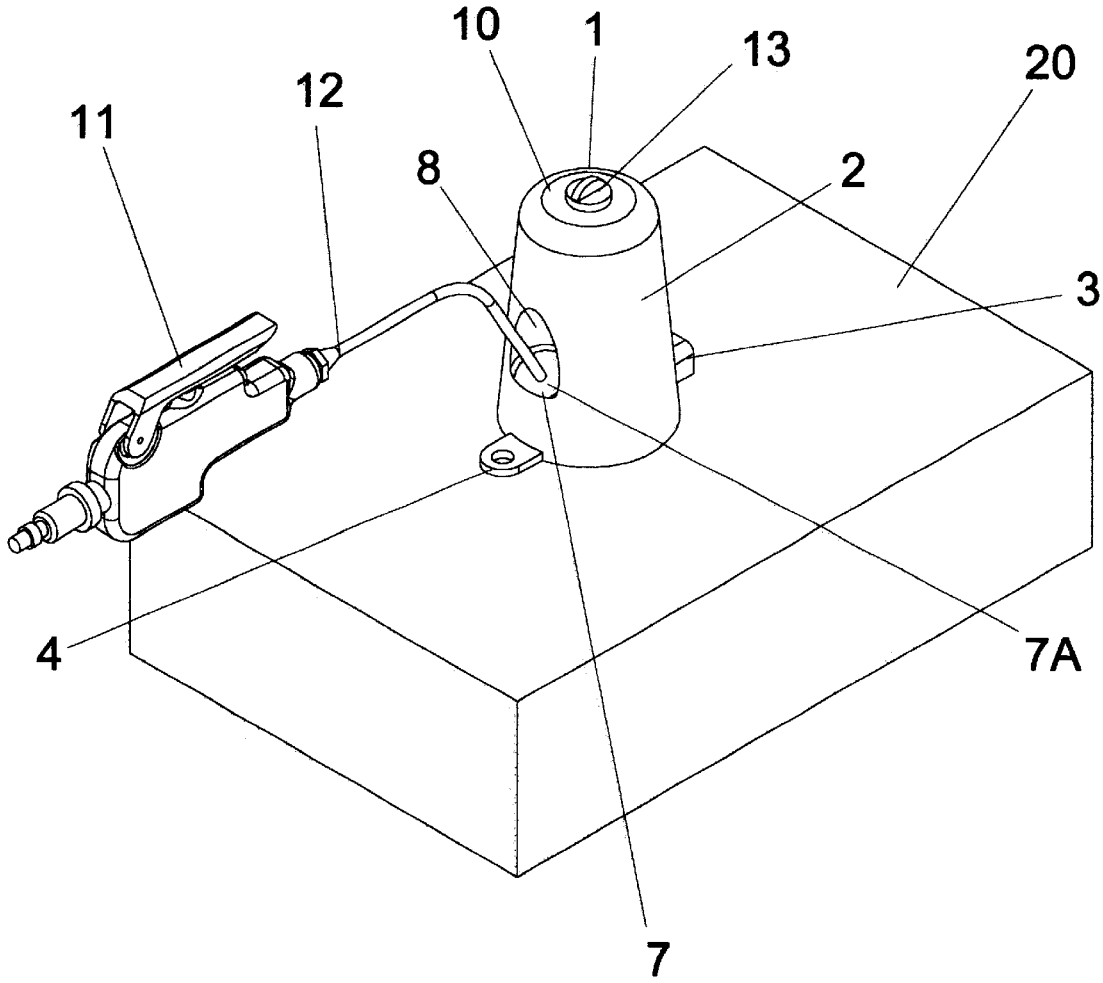
FIG. 2 illustrates the blind hole flushing shield from FIGS. 1 and 1A in position on a workpiece with an air gun.
Figure 8:
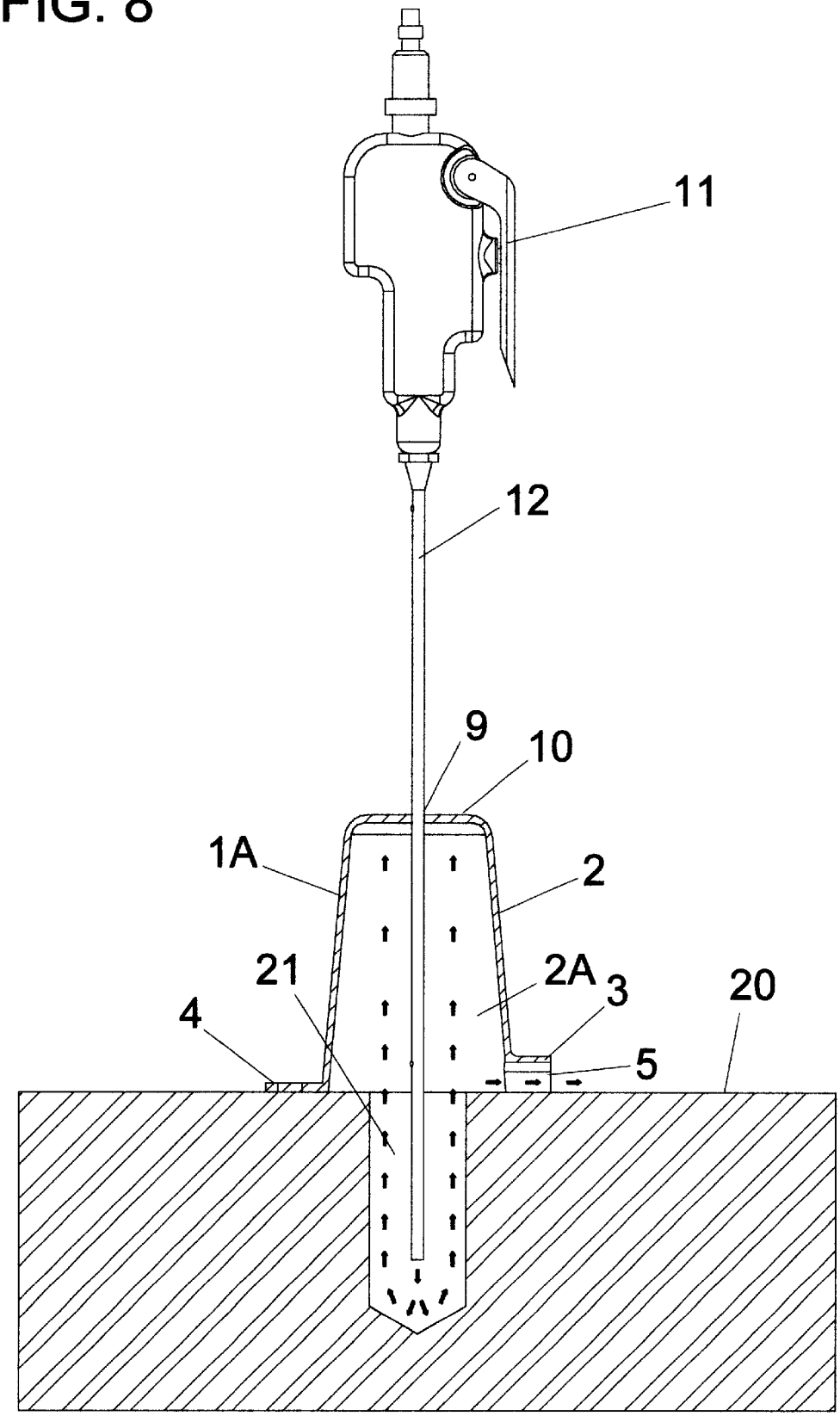
FIG. 8 illustrates the alternate embodiment of FIGS. 6 and 7 in operation.

FIG. 2 illustrates a prior art air gun 11 with a medium conduit 12, said medium conduit 12 inserted into the side guide clearance 7A with the plug 13 inserted into the top guide 10 to seal off the top guide clearance 9 (shown in FIGS. 1 and 1A). Said shield 1 is placed on a workpiece 20 over a blind hole 21 (Ref. FIG. 8).

Figure 3:
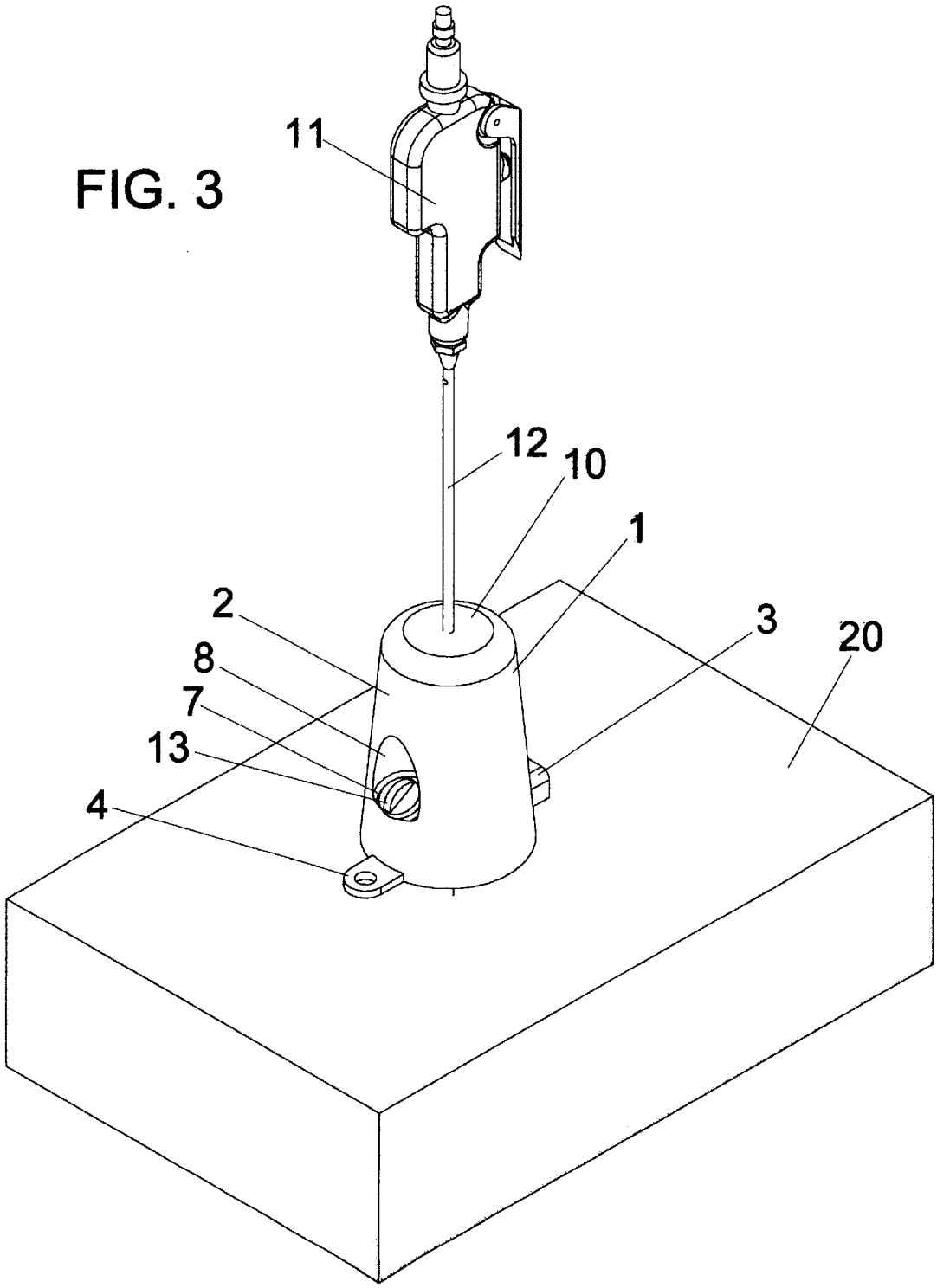
FIG. 3 illustrates the blind hole flushing shield with the air gun in an alternate location.

FIG. 3 illustrates said gun 11 with said conduit 12 inserted into the top guide 10 with the plug 13 inserted into the side guide 7 to seal off the side guide clearance 7A (Ref. FIGS. 1 and 2). Said shield 1 is shown placed on a workpiece 20 over the blind hole 21 (Ref. FIG. 8).

FIGS. 6, 7, 8, and 9 illustrate an alternate embodiment of the present invention, an alternate shield 1A comprising the case 2, the case cavity 2A, the outlet tunnel 3 with the tunnel exhaust clearance 5, the hanger 4, the bottom 6, the bottom clearance 6A, the top guide clearance 9, and the top guide 10. The alternate shield 1A is a simplified version of said shield 1 in that the alternate shield 1A does not include the side guide 7, the side guide clearance 7A, or the side guide reinforcement 8.

The alternate shield 1A is simpler while said shield 1 is more versatile and is useful where head room clearance is a problem.

Figure 4:
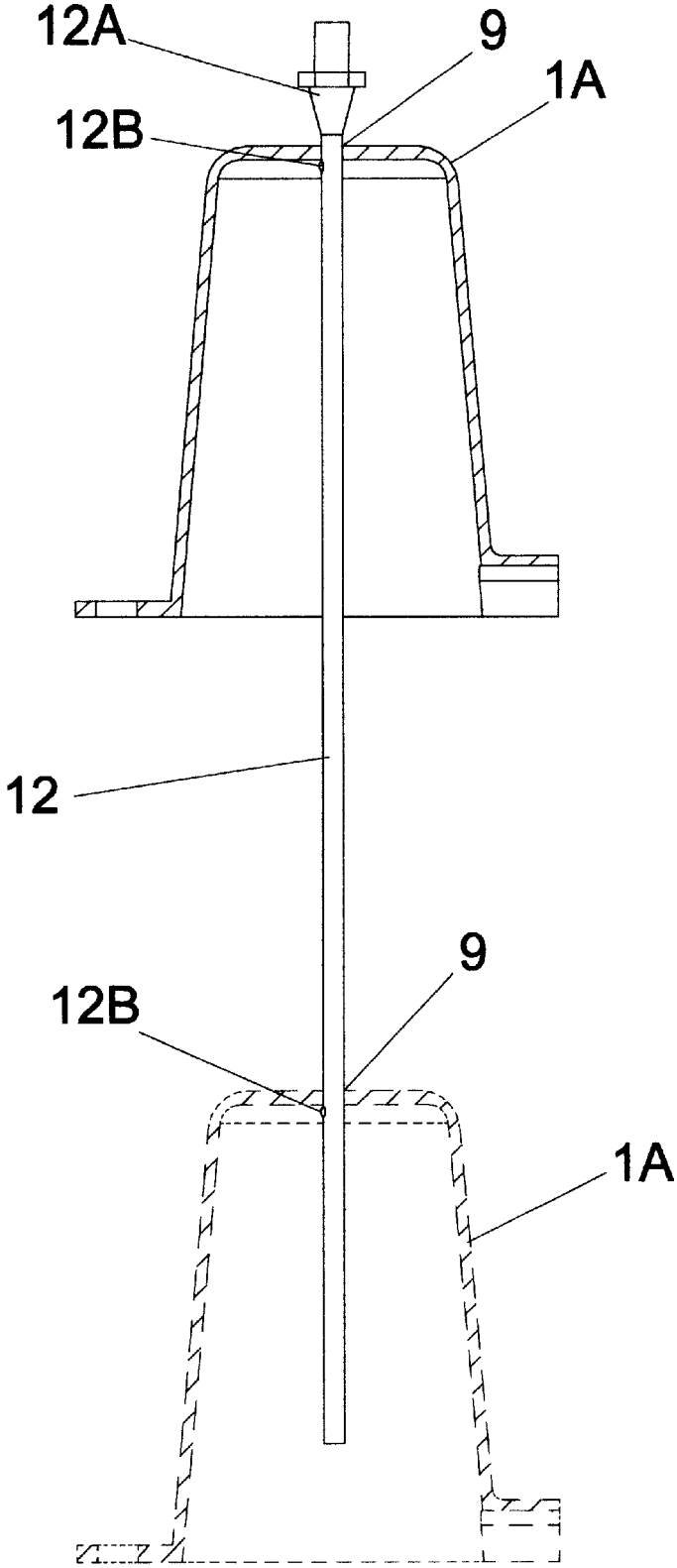
FIG. 4 illustrates an embodiment of the invention retained on a medium conduit.
Figure 5:
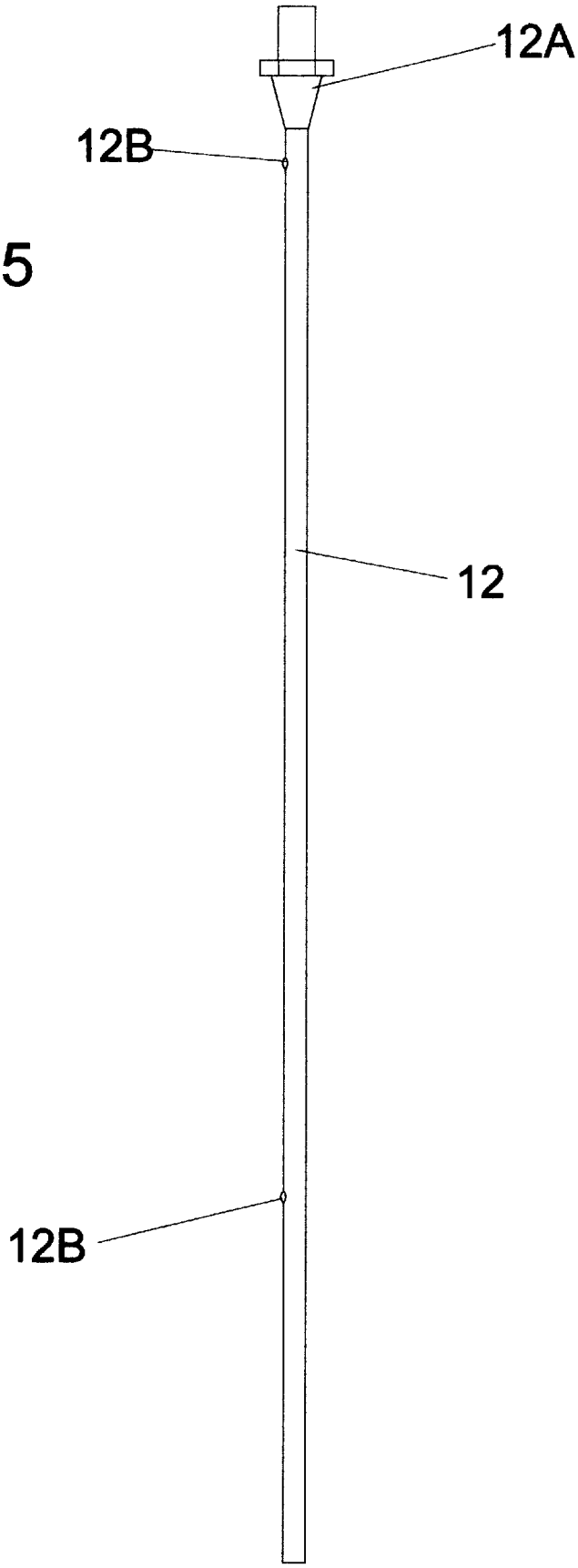
FIG. 5 illustrates the medium conduit from FIG. 4.
Figure 6:
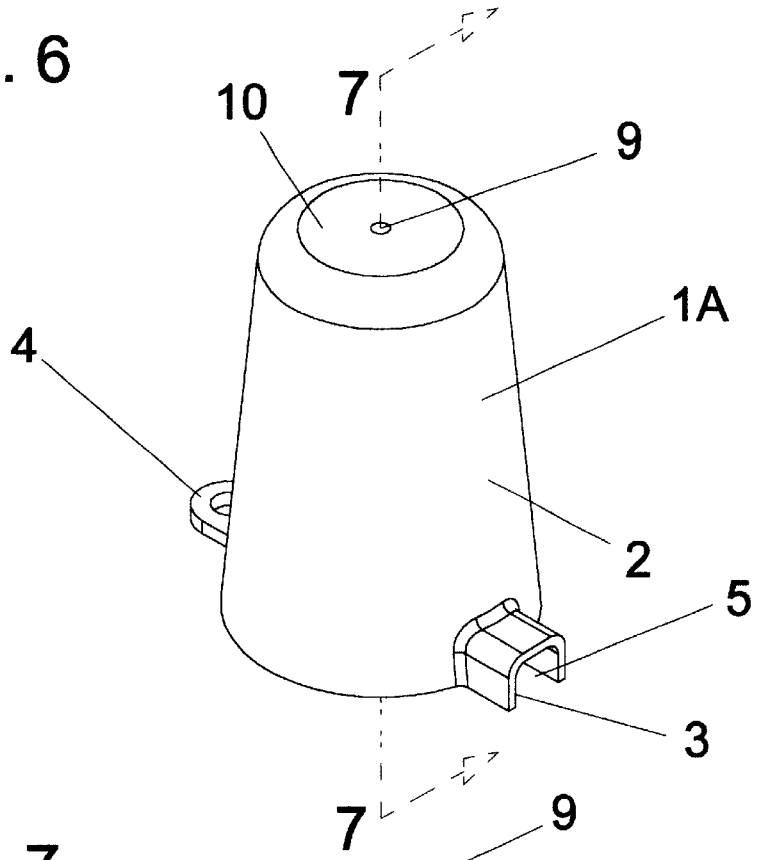
FIGS. 6 and 7 illustrate an alternate embodiment of the present invention.
Figure 7:
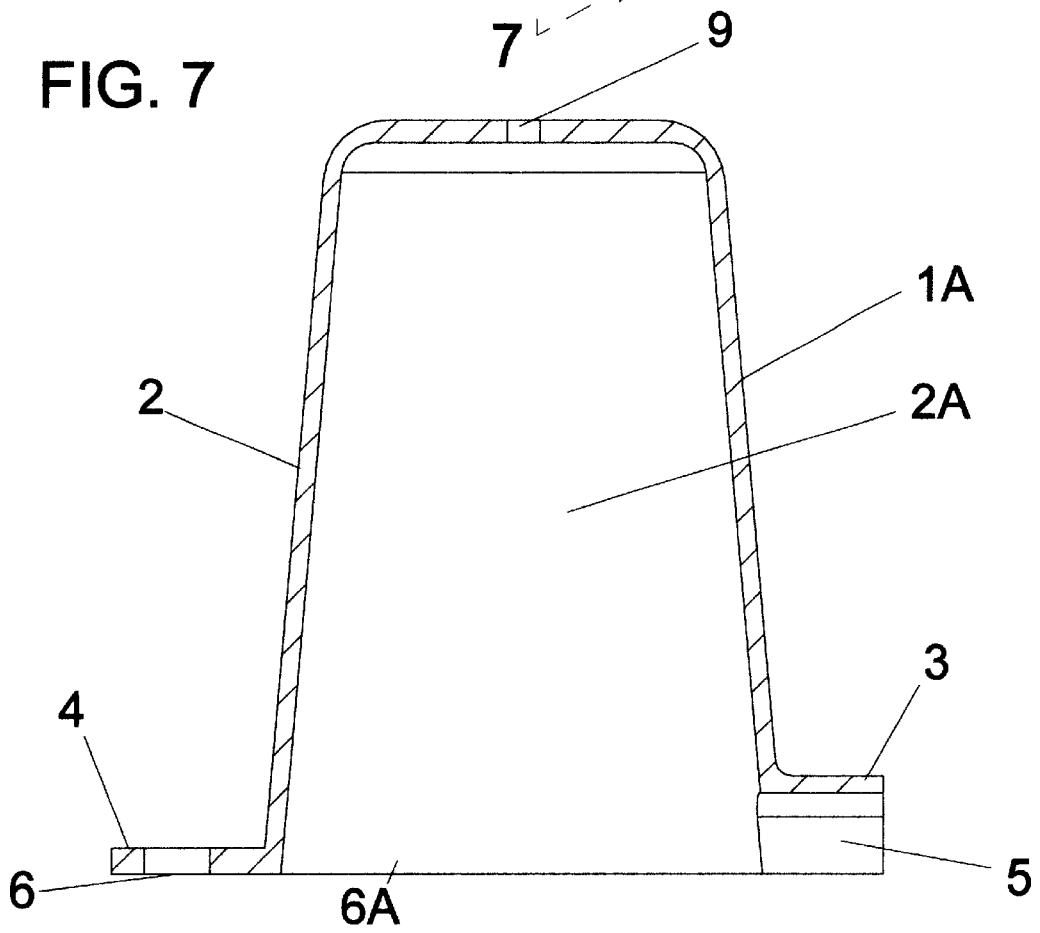

FIGS. 4 and 5 illustrate the medium conduit 12, in the preferred embodiment of the present invention, as comprising an adapter fitting 12A and spring loaded detents 12B.

Said detents 12B serve to hold said shield 1A to said medium conduit 12 as a convenience for handling and storage. The range of positioning of said conduit 12 within said shield 1A is indicated by the alternate position of said shield 1A shown by dotted lines in FIG. 4.

FIG. 8 illustrates the function of said shield 1A wherein said shield 1A is shown in position over the blind hole 21 in the work piece 20. Said shield 1A rests on the work piece 20, with the outlet tunnel 3 with the tunnel exhaust clearance 5 aimed in a safe direction, away from an operator or bystanders. In the preferred embodiment of the present invention, the hanger 4 serves not only as a convenient means for hanging said shield 1A on a tool board or rack, but also as an aid enabling an operator in visually aiming the outlet tunnel 3 with the tunnel exhaust clearance 5 so exhausted medium is directed as preferred by an operator.

In FIG. 8 the air gun 11 with said conduit 12 is positioned with said gun 11 above the top guide 10 with said conduit 12 inserted through the top guide clearance 9. Said gun 11 is merely a lever operated two way valve, supplied with an appropriate medium, such as a compressed gas such as, but not restricted to air or nitrogen or a liquid, such as, but not restricted to, water. Said gun 11 serves as a means of controlling the output of a medium.

When said gun 11 is opened to flow, the medium flows through said conduit 12 into the blind hole 21 and then out the tunnel exhaust clearance 5, as indicated by arrows. The tunnel exhaust clearance 5, in the preferred embodiment of the present invention, is sized to have an area sufficiently large to provide for a reduced velocity of pressurized medium so as to reduce any potential safety hazard, yet still have sufficient velocity to clean out loose debris from the blind hole 21 in the work piece 20.

Figure 9:
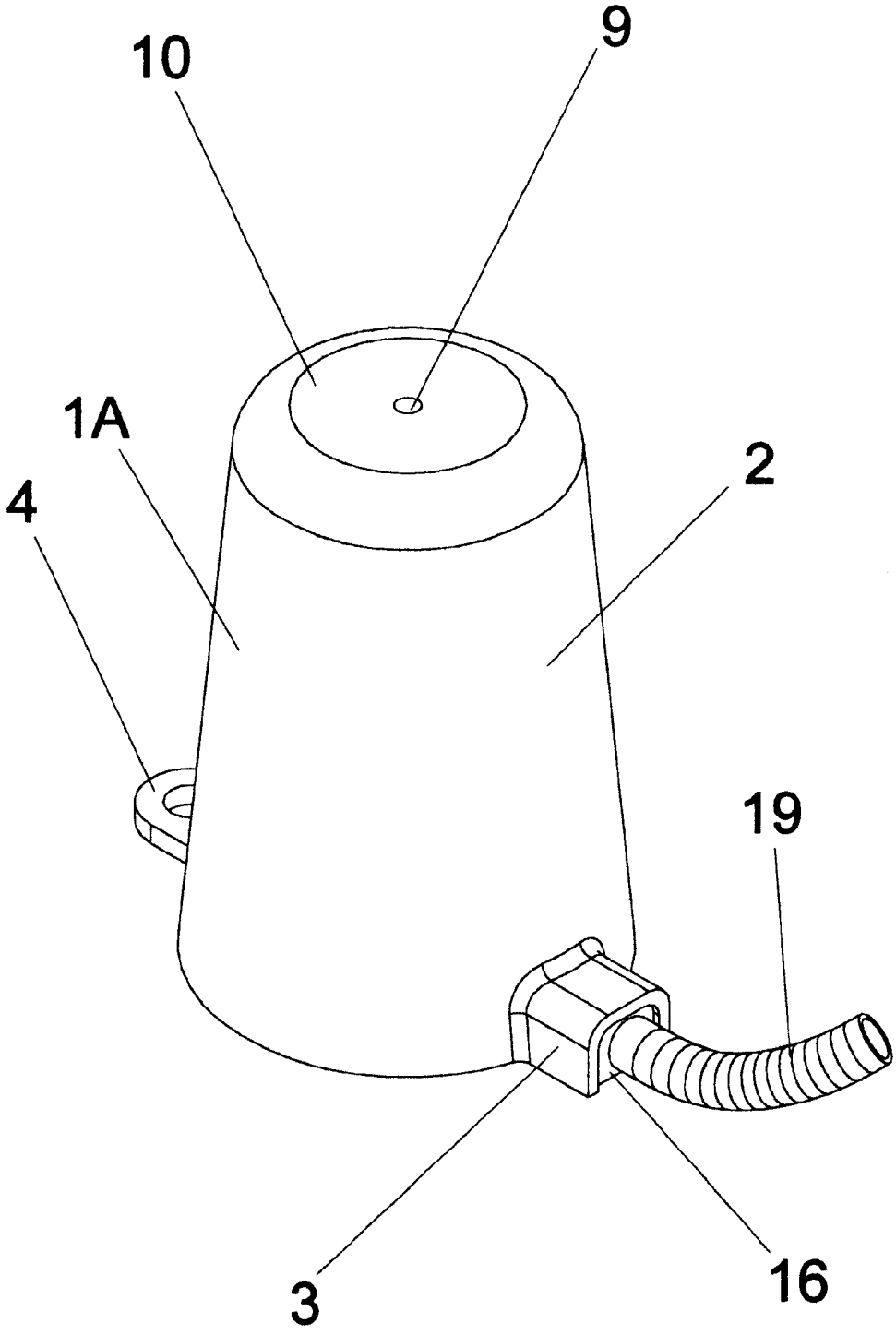
FIG. 9 illustrates the alternate embodiment of FIGS. 6 and 7 modified for use with vacuum.
Figure 10:
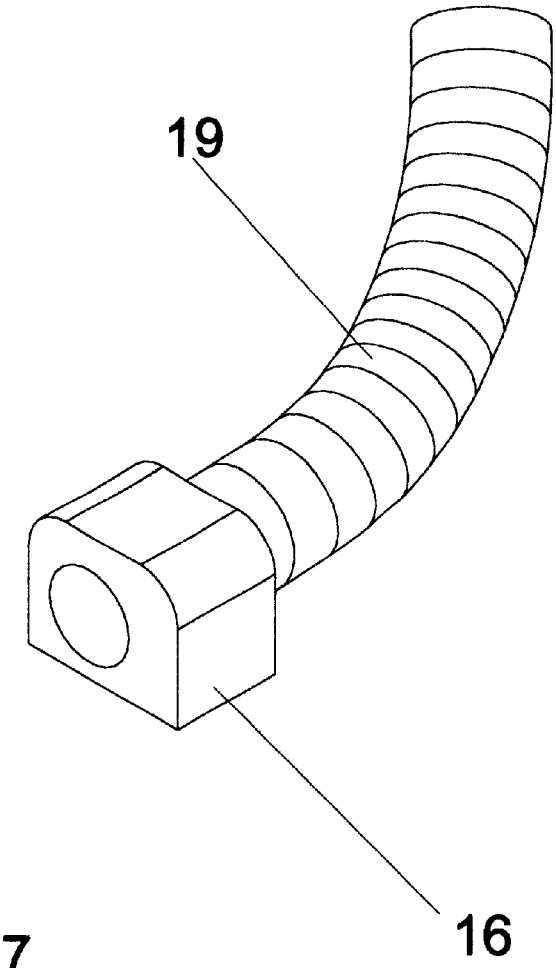
FIG. 10 illustrates a vacuum tube attached to a tunnel adapter.

Referring to FIGS. 9 and 10, said shield 1A further comprises a vacuum tube 19 attached to a tunnel adapter 16. When the tunnel adapter 16 is inserted into the exhaust tunnel 3, vacuum can be drawn through the vacuum tube 19 for removing chips and debris. This is especially applicable to wood working plants, such as wood furniture plants, in controlling dust accumulations, or to any shops or plants processing materials which are dusty when drilled, such as, but not restricted to, masonry and ceramic plants.

Figure 11:
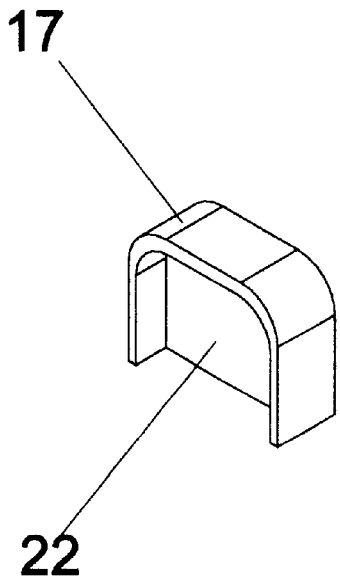
FIG. 11 illustrates a tunnel screen adapter with a screen.

FIG. 11 illustrates a tunnel screen adapter 17 comprising a screen 22 which can be inserted into the exhaust tunnel 3. The screen 22 serves as a filter preventing debris from escaping said shield 1A.

In the preferred embodiment of the present invention, as a best mode disclosure, said conduit 12 is a rigid tube, preferrably of metal, when used in through the top guide clearance 9.

As a best mode disclosure, said conduit 12 is a flexible plastic or elastomeric tube, in the preferred embodiment of the present invention, when used through the side guide clearance 7A. An angle of forty-five degrees angle between the conduit 12 and the work piece 20 is a best mode embodiment when the conduit 12 is inserted through the side guide clearance 7A.

The preferred embodiment of the present invention, said shield 1, comprises both the top guide 10 and the side guide 7 and a plug 13 which serves to plug whichever of the guides 7 or 9 not being used.

As implied in the nomenclature, said guides 7 and 10 guide the medium conduit 12 so a medium flowing through the medium conduit 12 is guided into said blind hole 21 from whence said medium can flush debris out of said blind hole 21 flowing out of said blind hole 21 with dislodged debris through the tunnel exhaust clearance 5.

The preferred material of construction of the present invention is an injection moldable clear plastic with adequate structural properties. There are a number of such plastics well known to the trade. However, other materials such as aluminum would suffice.

Although the description above contains many specificities, these should not be construed as limiting the scope of the invention but as merely providing illustrations of some of the presently preferred embodiments of this invention.

For example, while this is a very effective approach to blind holes drilled in metal, it is also applicable to other materials such as, but not restricted to, wood, plastic, and masonry products.

Also, while compressed air is discussed, compressed nitrogen and pressurized liquids can also serve the intended objects of the preferred embodiment of the present invention, including, but not restricted to, flushing debris out of a blind hole.

Also, this invention is not restricted to drilled blind holes. It is also applicable to blind broached holes, or any type of blind hole, irrespective of how the blind hole was put in a work piece. The device is generally useful whenever there is a need to contain a flowing medium; for example in cleaning any cavity in a machined surface with compressed air.

An advantage of using a clear plastic as a material of construction is to enable an operator to view drilled material being flushed.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A device useful in flushing debris from a blind hole comprising:

a) a case, b) an exhaust clearance, c) a bottom clearance, d) at least one guide with a clearance, and e) a plug usable for plugging said at least one guide with a clearance, wherein said device can rest on a work piece, with the device in position over a blind hole, with said at least one guide with a clearance guiding a conduit through which a medium flows so that said medium is guided into said blind hole from whence said medium can flush debris out of said blind hole flowing out of said blind hole with dislodged debris through said exhaust clearance.

2. The device of claim 1 further comprising more than one guide, at positions permitting an air gun to be usable at alternate locations comprising:

a) a first position with said air gun above a top guide with a conduit inserted through a top guide clearance, said conduit directing said medium towards said blind hole and b) a second position with said air gun positioned so an attached medium conduit is inserted through a side guide clearance in a side guide, directing said medium towards said blind hole, wherein a guide plug is usable for plugging whichever guide is not being used.

3. The device of claim 2 further comprising a hanger which is useful for hanging said device as well as serves as an aid enabling an operator in visually aiming said exhaust clearance in a safe direction.

4. The device of claim 3 further comprising a medium conduit further comprising detents holding said device on said medium conduit as a convenience for handling and storage.

5. A device useful in flushing debris from a blind hole comprising:

a) a case, b) an exhaust clearance, c) a bottom clearance, d) at least one guide with a clearance, and e) a medium conduit further comprising detents holding said device on said medium conduit as a convenience for handling and storage, wherein said device can rest on a work piece, with the device in position over a blind hole, with said at least one guide with a clearance guiding a conduit through which a medium flows so that said medium is guided into said blind hole from whence said medium can flush debris out of said blind hole flowing out of said blind hole with dislodged debris through said exhaust clearance.

* * * * *